US010760258B2

(12) United States Patent
Dineen et al.

(10) Patent No.: US 10,760,258 B2
(45) Date of Patent: Sep. 1, 2020

(54) AUTOMATED ANTI-FREEZE SYSTEM FOR SEWER JETTER SYSTEM

(71) Applicant: Spartan Tool, LLC, Mendota, IL (US)

(72) Inventors: Kevin T. Dineen, South Bend, IN (US); Brian Christopher Binns, Saint Joseph, MI (US)

(73) Assignee: SPARTAN TOOL, LLC, Mendota, IL (US)

( * ) Notice: Subject to any disclaimer, the term of this patent is extended or adjusted under 35 U.S.C. 154(b) by 0 days.

(21) Appl. No.: 16/280,501

(22) Filed: Feb. 20, 2019

(65) Prior Publication Data

US 2019/0257067 A1 Aug. 22, 2019

Related U.S. Application Data

(60) Provisional application No. 62/633,886, filed on Feb. 22, 2018, provisional application No. 62/661,799, filed on Apr. 24, 2018.

(51) Int. Cl.

| | |
|---|---|
| ***E03F 3/02*** | (2006.01) |
| ***E03F 5/00*** | (2006.01) |
| ***E03B 7/12*** | (2006.01) |
| ***E03F 9/00*** | (2006.01) |

(52) U.S. Cl.

CPC ..... *E03F 3/02* (2013.01); *E03B 7/12* (2013.01); *E03F 5/00* (2013.01); *E03F 9/00* (2013.01)

(58) Field of Classification Search

CPC ..... E03F 3/02; E03F 5/00; E03F 9/00; E03B 7/12

See application file for complete search history.

(56) References Cited

U.S. PATENT DOCUMENTS

| | | | | |
|---|---|---|---|---|
| 4,531,538 | A | 7/1985 | Sandt et al. | |
| 5,488,968 | A | 2/1996 | Price et al. | |
| 6,196,246 | B1 * | 3/2001 | Folsom | E03B 7/12 122/504 |
| 6,763,845 | B2 * | 7/2004 | Hoggard | E03B 7/10 137/434 |

OTHER PUBLICATIONS

International Search Report and Written Opinion for PCT/US2019/018725, dated May 21, 2019, 13 pp.

* cited by examiner

*Primary Examiner* — Kevin L Lee

(74) *Attorney, Agent, or Firm* — Brinks Gilson & Lione

(57) ABSTRACT

An automated system for a jetter system, a method for automatically filling a sewer access system with antifreeze liquid, and a method for automatically recapturing antifreeze within a sewer access system are provided. The automated system may include: a control system configured to provide a normal operational mode, an auto antifreeze mode, and an auto recapture mode; a pump; first and second tanks, and conduits that connect these components. The system automatically fills the conduits with antifreeze liquid from the second tank and then can automatically purge the conduits of antifreeze liquid and return the antifreeze liquid to the second tank for later use in again filing the conduits with antifreeze liquid.

20 Claims, 12 Drawing Sheets

AUTOMATED ANTI-FREEZE SYSTEM FOR SEWER JETTER SYSTEM

CROSS-REFERENCE TO RELATED APPLICATIONS

This application claims priority from U.S. Provisional Application No. 62/633,886, filed on Feb. 22, 2018, and from U.S. Provisional Application No. 62/661,799, filed on Apr. 24, 2018, the entirety of which are each hereby fully incorporated by reference herein.

BACKGROUND

In the pressure washer and sewer jetter industry, to operate in winter, users must run antifreeze through the water system to prevent the pump and critical components from freezing between jobs. Current procedure is manual and complicated for new users to complete effectively. As a result, every year multiple sewer jetters that are antifreezed incorrectly are damaged and cost customers hundreds of dollars.

It may be desirable to provide a system that allows for automatically antifreezing a sewer jetter system and automatically recapturing antifreeze within a sewer jetter system for reuse.

BRIEF SUMMARY

According to some aspects of the present disclosure, an automated system for a sewer access system is provided. The automated system may include: a control system configured to provide a normal operational mode, an auto antifreeze mode, and an auto recapture mode; a pump; a first tank selectively connectable with the pump through a first valve that is controllable by the control system, wherein the first valve is a three way valve which has a first position that directs liquid from the first tank to the pump, a second position that directs liquid from a second tank to the pump; a second valve connected to the pump via a first conduit; an unloader connected to the second valve with a second conduit; a third valve connected to the unloader through a third conduit, wherein the second valve is connected to the third valve through a fourth conduit, and the third valve is connected to the second tank through a fifth conduit and is connected to the first tank through a sixth conduit; and a working conduit connected to the unloader at a first end of the working conduit, with an opposite second end of the working conduit connectable to the third valve via a seventh conduit. Positions of the respective second and third valves are controlled by the control system.

The automated system is configured to allow transition from the normal operational mode to the auto antifreeze mode automatically based upon an instruction from an user of the system and when the second end of the working conduit is connected with the seventh conduit, wherein the transition from the normal operational mode to the auto antifreeze mode comprises the control system selectively operating the pump, and selectively operating each of the first, second, and third valves, to urge flow of antifreeze liquid from the second tank through each of the first, second, third, fourth, fifth, sixth, seventh conduits and the working conduit such that in the auto antifreeze mode, each of the first, second, third, fourth, fifth, sixth, and seventh conduits and the working conduit are filled with the antifreeze liquid from the second tank.

The automated system is also configured to transition from the auto antifreeze mode to the auto recapture mode to urge the antifreeze liquid from the system to be removed from the first, second, third, fourth, sixth, seventh conduits and the working conduit and be replaced by liquid from the first tank, wherein the transition from the auto antifreeze mode to the auto recapture mode comprises the control system selectively operating the pump, and selectively operating each of the first, second, and third valves to urge flow of liquid from the first tank through each of the first, second, third, fourth, sixth, and seventh conduits and the working conduit such that in the auto recapture mode each of the first, second, third, fourth, sixth, and seventh conduits and the working conduit are filled with fluid from the first tank According to some aspects of the present disclosure, a method for automatically filling a sewer access system with antifreeze liquid is provided such that antifreeze liquid may be automatically circulated to all parts of the system to protect the system from freezing in cold weather. The method comprises: setting the sewer access system to an auto antifreeze mode through a control system; automatically positioning a first valve to direct an antifreeze liquid from a second tank to a pump, the second tank provided to store antifreeze liquid, and setting a second valve and a third valve to their respective first positions; pulling antifreeze liquid from the second tank to the pump via the first valve and then further to the second valve through a first conduit; directing the antifreeze liquid flowing through the first conduit, via the second valve, through a fourth conduit and into the third valve; automatically shifting the second valve to a second position; directing the antifreeze liquid flowing through the first conduit from the pump, via the second valve, through a second conduit and into an unloader; directing the antifreeze liquid from the unloader to the third valve through a working conduit and a third conduit; directing the antifreeze liquid flowing through the third conduit, via the third valve, through a sixth conduit toward a first tank that is provided to store water for use in normal operations of the sewer access system; automatically shifting the third valve to a second position; directing the antifreeze liquid flowing through the third conduit, via the third valve, through the fifth conduit toward the second tank; and automatically stopping the pump once the control system concludes that first, second, third, fourth, fifth, and sixth conduits have received antifreeze therethrough.

According to some aspects of the present disclosure, a method for automatically recapturing antifreeze liquid within a sewer access system is provided such that antifreeze liquid within the system may be automatically recaptured for reuse. The method comprises: setting the sewer access system to an auto recapture mode through a control system; automatically reconfiguring a first valve to direct water from a first tank to a pump, wherein the first tank is configured to receive water for use by the sewer access system, setting a second valve to its first position, and setting a third valve to its second position; directing water from the first tank to the pump and then to the second valve through a first conduit; directing the water flowing through the first conduit, via the second valve, through a fourth conduit and into the third valve; automatically shifting the second valve to its second position; directing the water flowing through the first conduit, via the second valve, through the second conduit and into an unloader; directing the water from the unloader to the third valve through a working conduit and a third conduit; automatically shifting the second and third valves to their respective first positions; directing the water flowing through the first conduit, via the second valve, to the third valve through the fourth conduit, and then via the third valve, to the first tank through the sixth conduit; and automatically stopping the pump.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

BRIEF DESCRIPTION OF THE DRAWINGS

The accompanying drawings, which are included to provide further understanding of the subject technology and are incorporated in and constitute a part of this description, illustrate aspects of the subject technology and, together with the specification, serve to explain principles of the subject technology.

DETAILED DESCRIPTION OF THE DRAWINGS AND THE PRESENTLY PREFERRED EMBODIMENTS

Figure 1:
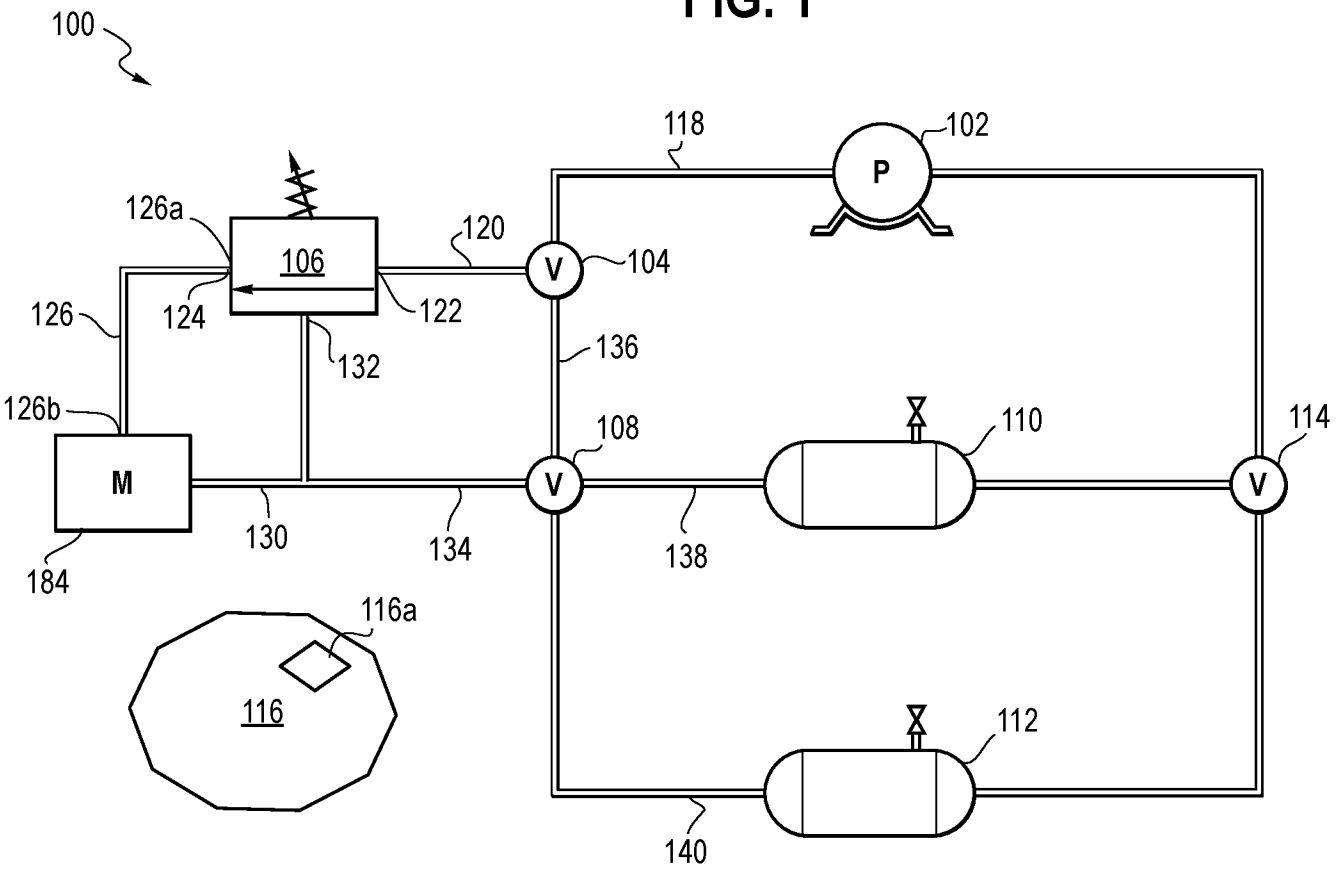
FIG. 1 shows a block diagram of an automated anti-freeze system for a sewer jetter system according to an embodiment of the invention.

Various embodiments are described below with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly.

FIG. 1 shows a non-limiting example embodiment of an automated system 100 for a jetter system. Jetter systems are often known for remote inspection or flushing of a sewer line or other piping system, with the use of water flowing through a working conduit, which is extended from the system into the sewer to be inspected. The flow of water may act to propel an end of the working conduit into the sewer as well as to flush areas of the sewer such as to remove clogs or debris. The working conduit may include a conduit, a tool, various sensors, or other components for interaction with the location within the sewer where the end of the working conduit is located. Because the jetter uses water (stored within a tank within the system) for various activities, various components of the jetter that contain water during extended periods of non-use is at risk for freezing and the resultant damage that may be caused due to freezing and specifically in some circumstances the natural expansion of water as it freezes. The system 100 disclosed herein is provided to allow for automatic removal of water within various components of the jetter and replacement with antifreeze liquid when called for by the user, and then automated flushing the antifreeze liquid from the same components of the jetter to be stored in a dedicated tank for later use again in the jetter.

In an embodiment, as shown in FIG. 1, the automated system 100 comprises a control panel 116, a pump 102, a first valve 114, a second valve 104, a third valve 108, an unloader 106, a working conduit 126, a first tank 110, and a second tank 112. The various components are fluidly connected with conduits as depicted in FIG. 1 to fluidly connect the components together (based upon differing positions of the first valve 114, the second valve 104, and the third valve 108) as well as selected operation of the pump 102, to allow the system 100 to transition from a normal operational mode wherein the various conduits (with the exception of the fifth conduit 140) are filled with water (or another working fluid of the system), to an auto antifreeze mode wherein each of the various conduits are filled with anti-freeze liquid (such as ethylene glycol or another suitable fluid) to allow for transport and storage of the system in a cold environment without the possibility of liquid within the system freezing. The system also is configured to transfer from the auto antifreeze mode to an auto recapture mode, which removes antifreeze from all of the conduits (with the exception of the fifth conduit 140) and returns all (or in some embodiments all with the exception of the liquid within the sixth conduit 138) of the antifreeze liquid to the second tank 112, and returns water (or other working fluid) to the remaining conduits. The system is configured to be operated automatically by a control system 116*a* (shown schematically within a control panel 116) to transition between the various modes based upon selective operation of the first, second, and third valves 114, 104, and 108.

Figure 11:
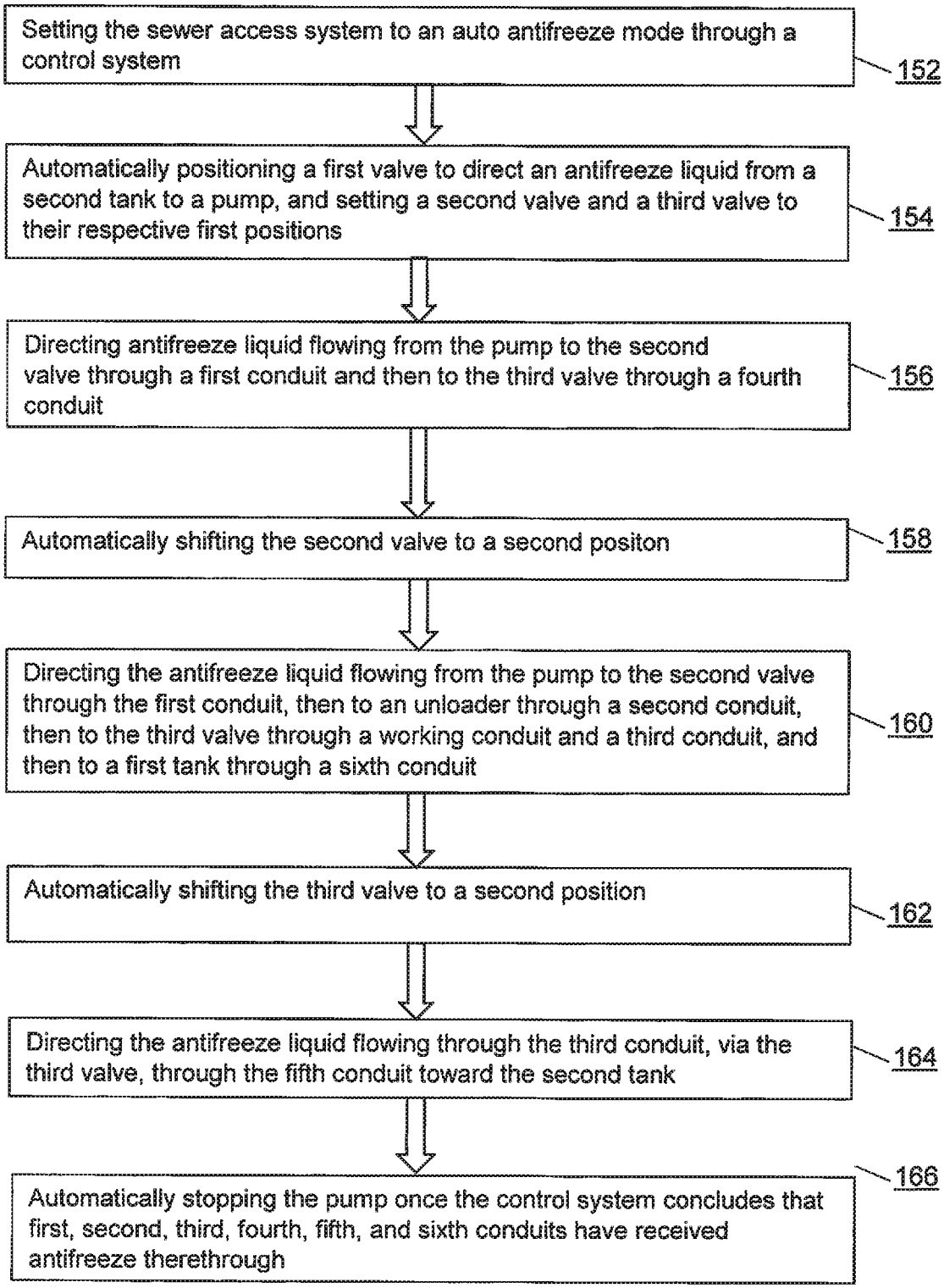
FIG. 11 shows a flow chart indicating a method for automatically filling a sewer jetter system with antifreeze liquid, according to a method of an embodiment of the invention.
Figure 12:
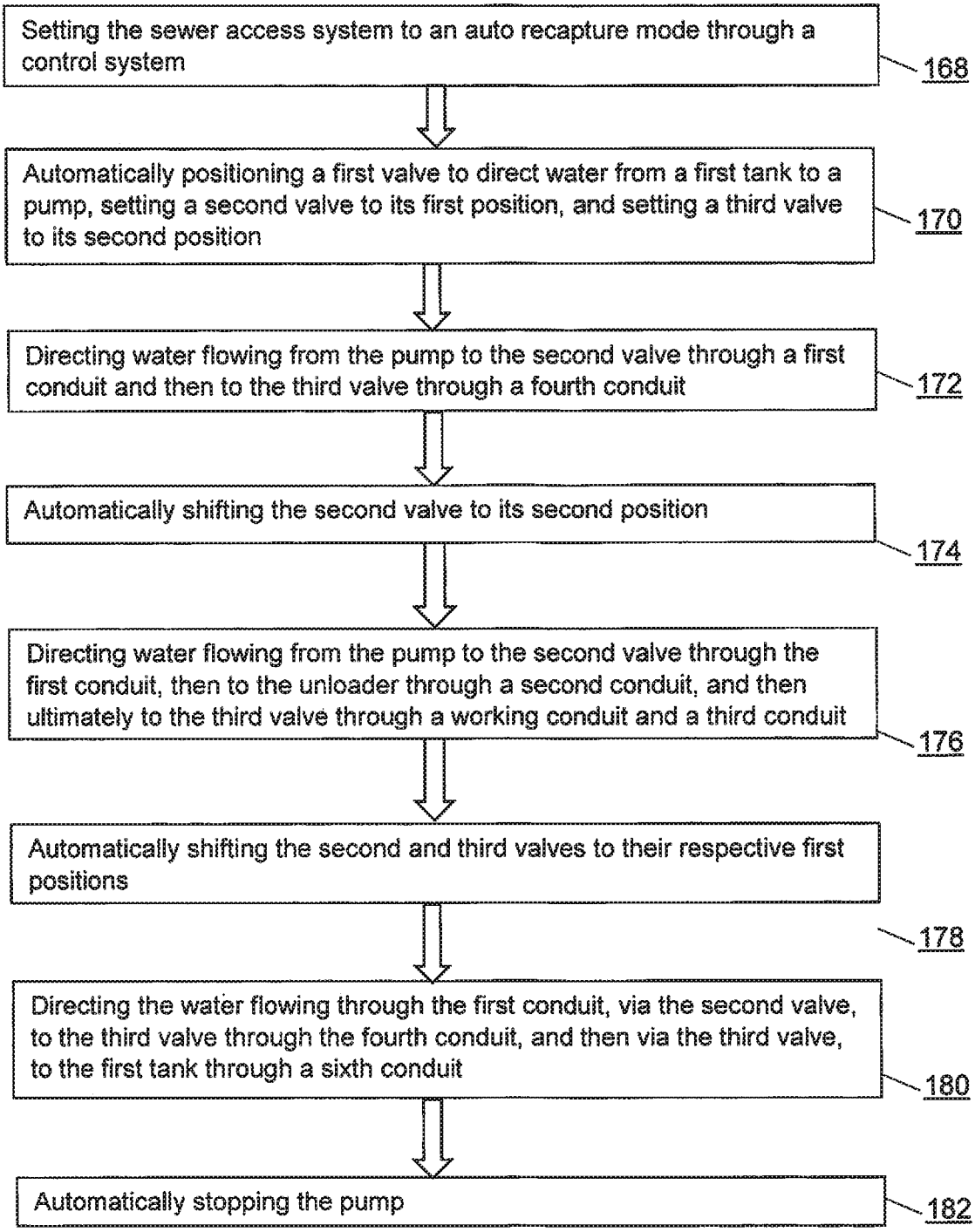
FIG. 12 shows a flow chart indicating a method for automatically recapturing antifreeze within a sewer jetter system, according to a method of an embodiment of the invention.

As discussed in a representative embodiment herein, the system may include separate second and third valves 104, 108, which are connected together with a conduit 138. In some other embodiments, the second and third valves 104, 108 may be a single valve assembly (such as a single manifold that is operated to allow or prevent flow through the various conduits that enter into and leave the manifold). In these embodiments, the second and third valves 104, 108 are incorporated by the single manifold with the functionality and various operational positions of the second and third valves 104, 108 being retained as described herein. Similarly, this embodiment describes a set up various conduits to allow for water and antifreeze flow in various directions through the various conduits and the first, second and third valves as discussed herein. One of ordinary skill in the art after a thorough review and understanding of this specification and figures will easily understand that other conduits and flow paths are potentially available within the scope of this disclosure, and altering the routine of the control system 116*a*, discussed herein, is possible. By way of example, the steps 156 and 160 as depicted in FIG. 11 and discussed below could be swapped such that step 160 occurs before step 156. Similarly, steps 172 and 176 as depicted in FIG. 12 and discussed below could be swapped such that step 176 occurs before step 172. One of ordinary skill in the art will understand that other steps could be swapped or changed (depending upon different flow paths between the first tank, the second tank through the first valve to the various conduits discussed below) and one of ordinary skill could readily identify the routine that the control system 116*a* would take to initially flush and fill the system 100 with antifreeze during a period of non-use (FIGS. 3-6 and 11) and to flush the antifreeze from the system and return it to the second tank (FIGS. 7-10 and 12).

Figure 2:
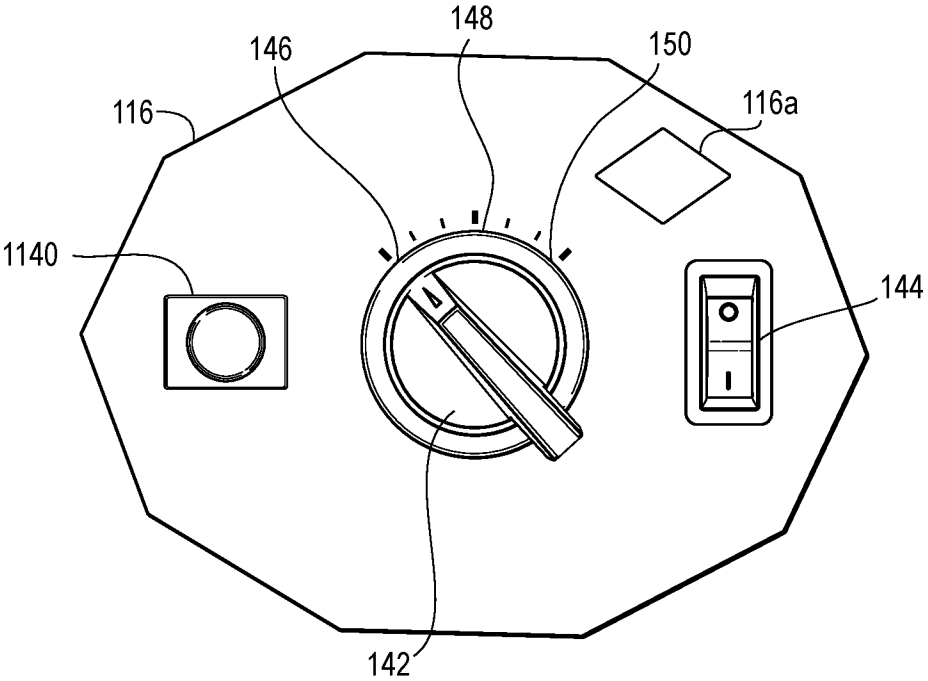
FIG. 2 shows a block diagram of a control panel of an automated anti-freeze system for a sewer jetter system according to an embodiment of the invention.
Figure 3:
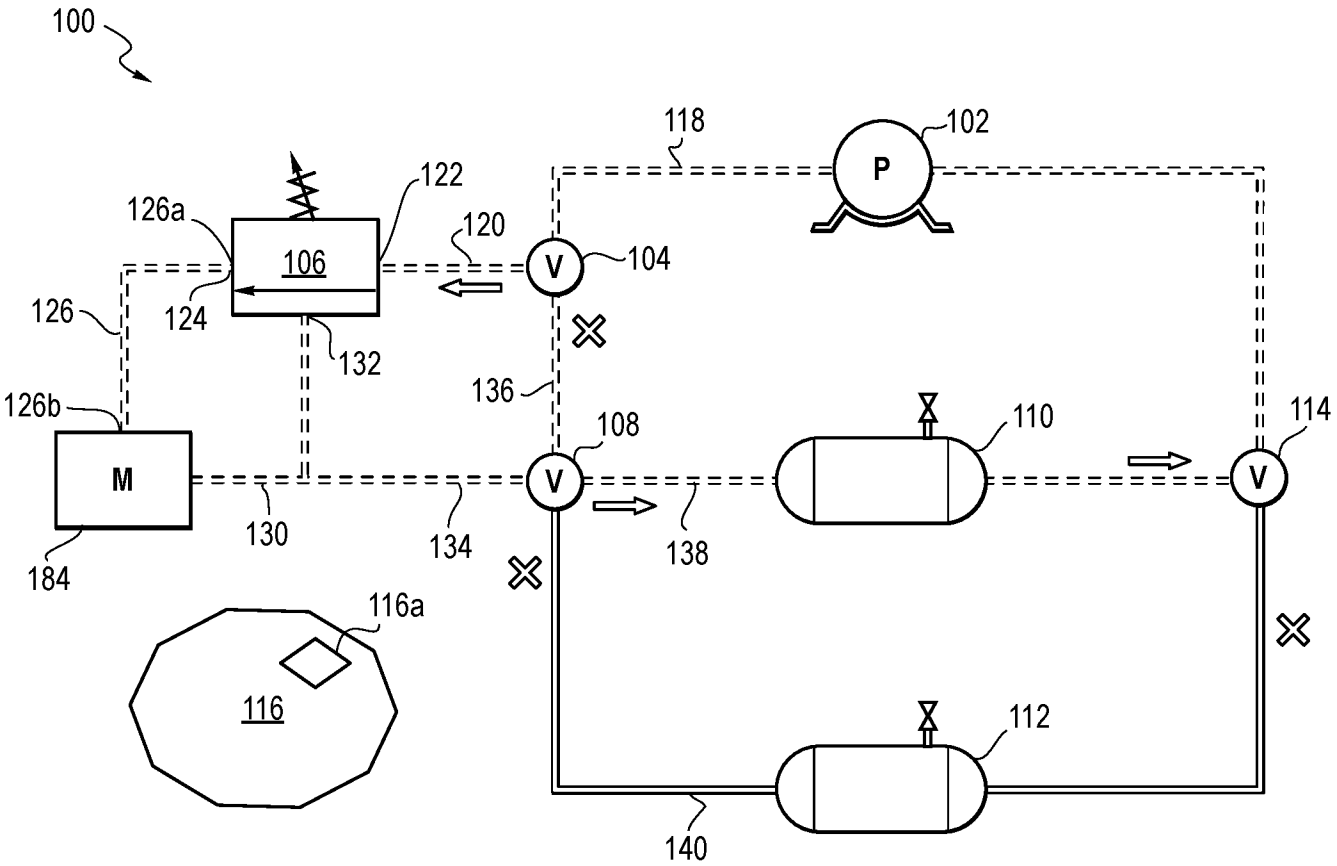
FIG. 3 shows a block diagram of an automated anti-freeze system for a sewer jetter system according to an embodiment of the invention at a normal operational state according to a method of an embodiment of the invention.

According to an embodiment, as shown in FIG. 2, the control panel 116 comprises a power switch 144, a rotary switch 142, and a ready button 1140. By operating the control panel 116, the operator of the jetter system may control the states of the system. The rotary switch 142 may provide three choices: auto antifreeze 146, normal operational 148, and auto recapture 150. When the rotary switch 142 is in the normal operational position 148, the jetter system may be in its normal working state as depicted in FIG. 3. If the operator has completed the use of the jetter in a cold weather location and will not immediately begin another use of the jetter system, the operator may transition the system to the auto antifreeze setting 146, which ultimately results in the system aligned as depicted in FIG. 7, and through the various operations as depicted in FIGS. 3-6.

According to an embodiment, the operator may (with the second end of the working conduit 126*b* connected to the manifold 184, which is fluidly connected to the third valve 108) rotate the rotary switch 142 from the normal operational position 148 to the auto antifreeze position 146, turn the power switch 144 on, and push the ready button 1140, such that antifreeze will automatically circulate within the whole system 100. When it is desired to again use the system, the operator may rotate the rotary switch 142 to the auto recapture position 150, turn the power switch 144 on, and push the ready button 1140, which, based upon the flow of liquid from the first tank 110, urges the antifreeze liquid within the system 100 to circulate automatically back into the second tank 112 (in some embodiments other than the antifreeze liquid located within the sixth conduit 138) as described below and depicted in FIGS. 7-10. Once the recapture of the antifreeze liquid is completed, the operator may turn the power switch 144 off and rotate the rotary switch 142 to the normal operational position 148 to use the system for its intended purpose.

Referring to FIG. 1, according to an embodiment, the pump 102 may be connected to the first tank 110 (which contains the working fluid for the system, which may be water) and a second antifreeze tank 112 (which may contain a liquid that resists freezing, such as conventional "antifreeze," which often includes a solution of ethylene glycol and water). The pump 102 may be connected to the first and second tanks 110, 112 via a first valve 114, which can be positioned to allow the pump 102 to take suction from the first or second tank 110, 112, depending upon the mode of operation of the system as discussed below. In some embodiments, the first valve is an automatic three-way valve that can be automatically repositioned as discussed above based upon instructions from the control system 116*a*. In some embodiments the first valve 114 may include a third position (or may be connected to another valve) to allow for fluid to drain from the system, which may be automatically operated based upon instructions from the control system 116*a* or manually operated. When the first valve 114 is positioned to direct liquid from the first tank 110 to the pump 102, liquid from the first tank 110 is pulled to and out of the pump 102 during operation, and then through the first conduit 118. When the first valve 114 is positioned to direct liquid from the second tank 112 to the pump 102, liquid from the second tank 112 is pulled to and out of the pump during operation, and then through the first conduit 118.

Referring to FIG. 1, according to an embodiment, the second valve 104 may be connected to the pump 102 through a first conduit 118 and be configured to direct liquid coming from the pump 102 into the system 100. The first conduit 118 (as well as any or all other conduits discussed herein) may be a rigid pipe or a flexible hose or a combination of the two. In some embodiments, the second valve 104 (and the third valve 108, discussed below) may be an automated valve with multiple input/outputs that is automatically repositionable to port various inputs and various outputs for flow through the valve in a specified manner, as operated by the control system 116*a*.

The second valve 104 may be connected to a first end 122 of an unloader 106. The unloader 106 is a conventional valve for a jetter system and is provided to allow the operator to adjust pressure (either manually or automatically by operation of the control system 116*a*) of fluid through the working conduit 126. The unloader 106 receives the first end 126*a* of the working conduit 126, with the opposite end (the second end of the working conduit 126*b*) extending therefrom freely during normal operations of the jetter system, such that fluid is expelled through a nozzle or other orifice in the opposite end of the working conduit 126. In some embodiments, the unloader 106 may include a vent that works in conjunction with the unloader 106 as commonly understood by those of ordinary skill in the art in the normal operation of a jetter system.

Figure 4:
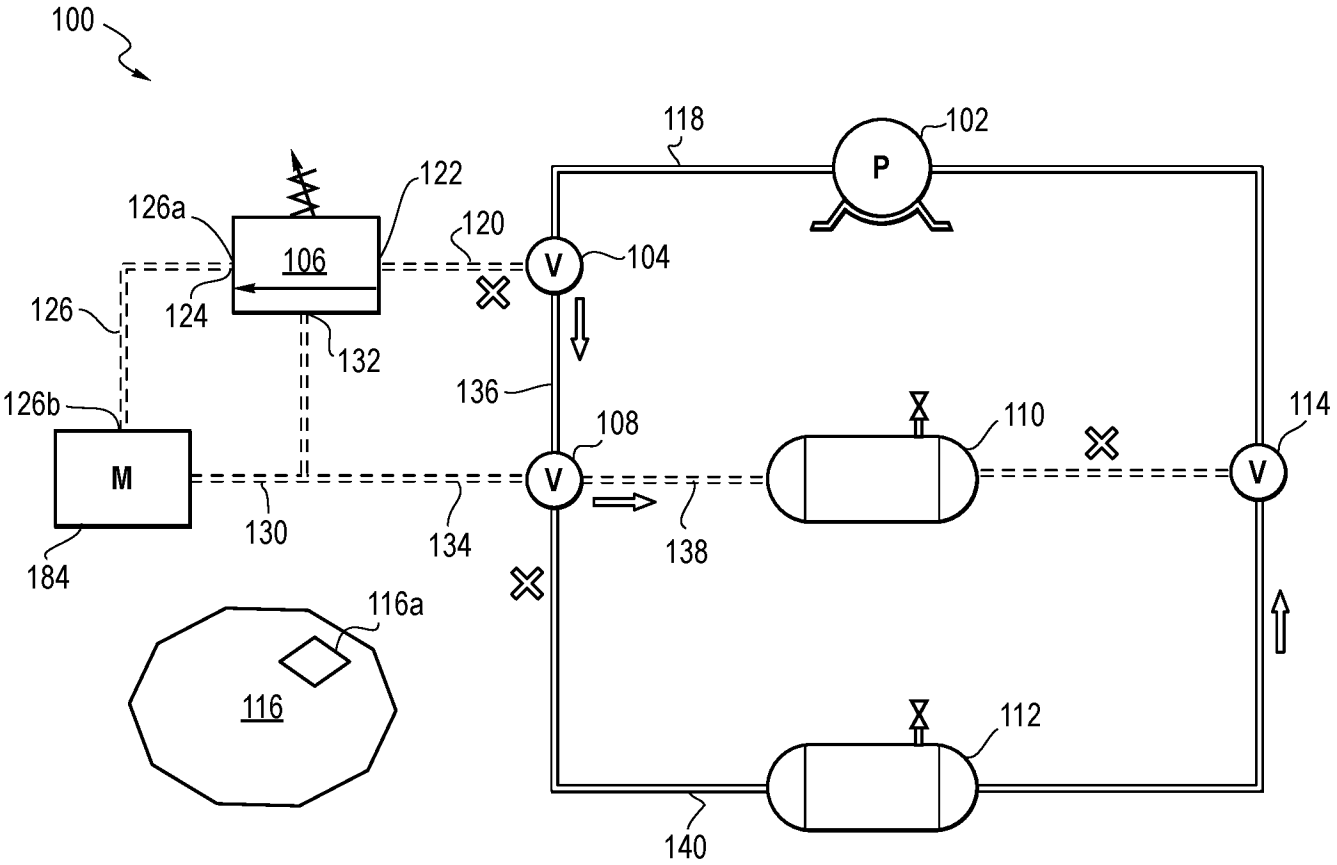
FIG. 4 shows a block diagram of an automated anti-freeze system for a sewer jetter system according to an embodiment of the invention at a first step of automatically filling a sewer jetter system with antifreeze liquid according to a method of an embodiment of the invention.

In some embodiments, the second and third valves 104, 108 may be fluidly connected with a fourth conduit 136. The second valve 104 may comprise two positions, as in some embodiments, controlled by the control system 116*a*. When the first auto valve is in the first position, liquid coming from the pump 102 is directed to the third valve 108 through the fourth conduit 136 (FIG. 4). When the second valve 104 is in the second position (FIG. 5), liquid from the pump 102 is directed to the unloader 106 via a second conduit 120.

Referring to FIG. 1, according to an embodiment, the working conduit 126, may be an elongate hose that can be stored upon a reel (not shown) and may be unfurled for use. The working conduit 126 may include a first end 126*a* and a second end 126*b*, through which fluid can be propelled therefrom during normal operations of the system. The first end 126*a* of the working conduit 126 may be wound on a reel (not shown in FIG. 1) and may be connected to a second end 124 of the unloader 106 through an elbow (not shown in FIG. 1). The second end 126*b* of the working conduit 126 may be connected to a third end 132 of the unloader 106 through a tee (not shown in FIG. 1). When the jetter system is in the normal operational state, the operator may disconnect the second end 126*b* of the working conduit 126 from the tee and put it into a drain or a sewer to perform the inner-cleaning job.

Referring to FIG. 1, according to an embodiment, the third valve 108 may be fluidly connected to the unloader 106 via a connection in the unloader 106 through a third conduit 134 at the third end 132 of the unloader 106. The third valve 108 may be connected to the first tank 110 through a sixth conduit 138 and may also be connected to the second tank 112 through a fifth conduit 140. The third valve 108 may comprise multiple positions, as operated by the control system 116*a*. When the third valve 108 is in a first position (FIG. 4), liquid flowing into the third valve 108 (either through the fourth conduit 136 from the second valve 104, or from the third conduit 134—either ultimately from the unloader 106 or the working conduit 126) is directed to the first tank 110 through the sixth conduit 138. When the third valve 108 is in a second position (FIG. 6), liquid entering the third valve 108 (from the same potential locations (depending upon the position of the second valve 104 as discussed herein) is directed to the second tank 112 through the fifth conduit 140.

In some embodiments, the unloader 106 may sense the pressure of the liquid flowing from the second valve 104. When the sensed pressure is higher than a predetermined pressure, the unloader 106 may direct the liquid centering into the unloader 106 into the working conduit 126 through the connected connection (such as an elbow) between the second end 124 of the unloader 106 and the first end 126*a* of the working conduit 126. When the sensed pressure is lower than the predetermined pressure, the unloader 106 may direct the liquid entering into the unloader 106 into a connection (such as a tee connection between the third end 132 of the unloader 106 and the third conduit 134 (FIG. 1).

FIGS. 3-6 show a non-limiting example embodiment of a method for automatically filling a jetter system with antifreeze liquid. In these figures, water in the system is shown with dashed lines, antifreeze in the system is shown with solid lines, and the positions of the first and second auto valves are shown with arrows.

When the system 100 is in the normal operational state, as shown in FIG. 3, the entire system 100 is filled with water except for the fifth conduit 140, which extends from the third valve 108 to the second tank 112 (normally full of antifreeze liquid). To automatically antifreeze the jetter system, the operator may rotate the rotary switch 142 on the control panel 116 to the auto antifreeze position 146, turn on the power switch 144, and push the ready button 1140, such that power is supplied to start the pump 102. When the rotary switch 142 is rotated to the auto antifreeze position 146, the control system 116*a* will check to confirm whether the second end 126*b* of the working conduit 126 is plugged into the manifold 184. The manifold 184 may include sensors that provide a signal to the control system 116*a* indicative of whether the second end 126*b* of the working conduit 126 is present at the sensors, and the control system 116*a* may operate the system based completely or partially upon the sensed results. According to some embodiments, if the sensed results indicate that the second end 126*b* of the working conduit 126 is not plugged into the manifold 184, there would be a prompt that requires the user to plug the second end 126*b* of the working conduit 126 into the manifold 184, and the pump will be started only when the sensed results indicate that the second end 126*b* of the working conduit 126 has been plugged in. According to some embodiments, there will be a prompt that requires the user to confirm that the second end 126*b* of the working conduit 126 is plugged into the manifold 184 once the rotary switch 142 is rotated to the auto antifreeze position 146.

After the control system confirms that the second end 126*b* of the working conduit 126 is plugged into the manifold 184, the second valve 104 and the third valve 108 automatically set to their respective first positions, and the first valve 114 automatically reconfigures to direct liquid from the second tank 112 to the pump 102 such that antifreeze liquid is pushed to the pump 102 via the first valve 114.

In the first step, as shown in FIG. 4, antifreeze coming from the pump 102 to the second valve 104 is directed to the third valve 108 through the fourth conduit 136, such that antifreeze liquid fills the first conduit 118 and the fourth conduit 136 and pushes water out of these conduits into the first tank 110 through the sixth conduit 138.

Once the antifreeze liquid coming from the pump 102 reaches the third valve 108 and no water remains within the first conduit 118 and the fourth conduit 136, as depicted in FIG. 4, the second valve 104 automatically shifts from its first position to its second position while the pump 102 is still on once the control system 116*a* concludes that no water remains within the first conduit 118 and the fourth conduit 136, such that liquid flowing through the pump 102 is directed by the second valve 104 through the second conduit 120 and into the unloader 106. In some embodiments, the control system 116*a* may be calibrated for how long to run the system in the orientation of each sub-routine in the method, i.e. how long to maintain the system as in the confirmation of FIGS. 3-6. The calibration may be related to predetermined parameters, such as a determined time needed to fill each portion of the system (i.e. the relevant conduits and valves, etc.) with antifreeze liquid—when previously filled with water-such that the system when each step is completed is expected to be fully of antifreeze liquid, while minimizing the time required to enter the anti-freeze mode as well as the volume of antifreeze liquid needed to fill the entire system. In other embodiments, one or more of the respective conduits may include sensors that provide a signal to the control system 116*a* indicative of whether water or anti-freeze liquid is present at the sensor, and the control system 116*a* may operate the system between the various orientations discussed herein based completely or partially upon the sensed liquids.

Figure 5:
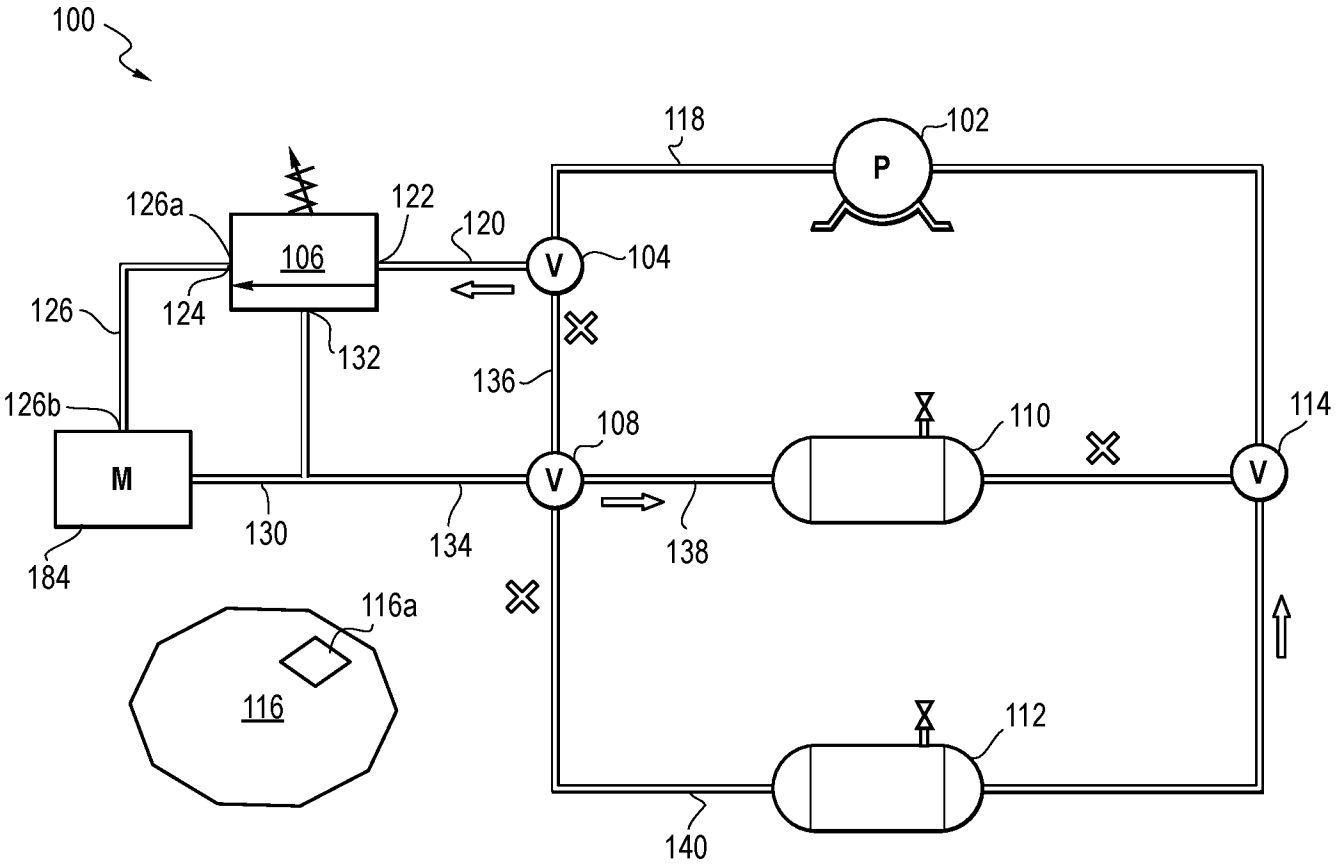
FIG. 5 shows a block diagram of an automated anti-freeze system for a sewer jetter system according to an embodiment of the invention at a second step of automatically filling a sewer jetter system with antifreeze liquid according to a method of an embodiment of the invention.

In the second step, as shown in FIG. 5, the second valve 104 has shifted to its second position and the third valve 108 remains in its first position. Liquid flowing through the first conduit 118 from the pump 102 is directed by the second valve 104 to the unloader 106, then ultimately to the third valve 108 via the working conduit 126, the seventh conduit 130, and the third conduit 134, and then is directed by the third valve 108 to the first tank 110 through the sixth conduit 138. When the system operates in this configuration for a sufficient time for antifreeze liquid to reach the first tank 110 (to ensure that the sixth conduit 138 is full of antifreeze liquid), the control system 116*a* concludes that the conduits of the system have been evacuated of all water and replaced with antifreeze liquid, including the pump 102, the first, second, third, fourth, fifth, sixth, and seventh conduits 118, 120, 134, 136, 140, 138, and 130, the second and third valves 104, 108, the unloader 106, and the working conduit 126.

Once the control system 116*a* concludes that no water remains within the system, as depicted in FIG. 5, the third valve 108 automatically shifts from its first position to its second position while the pump 102 is still on, such that liquid flowing through the third conduit 134 is directed by the third valve 108 through the fifth conduit 140 and into the second tank 112.

Figure 6:
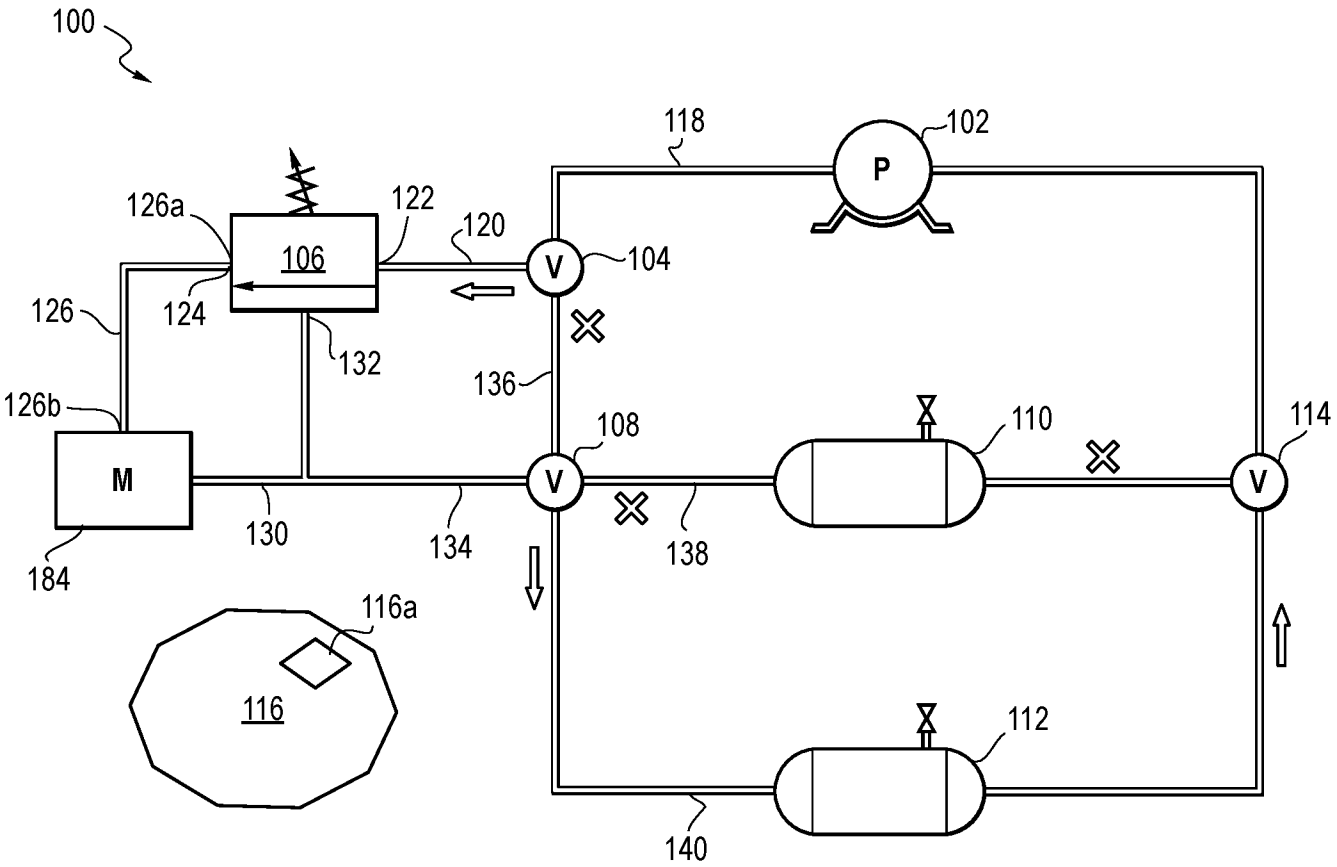
FIG. 6 shows a block diagram of an automated anti-freeze system for a sewer jetter system according to an embodiment of the invention at a third step of automatically filling a sewer jetter system with antifreeze liquid according to a method of an embodiment of the invention.
Figure 7:
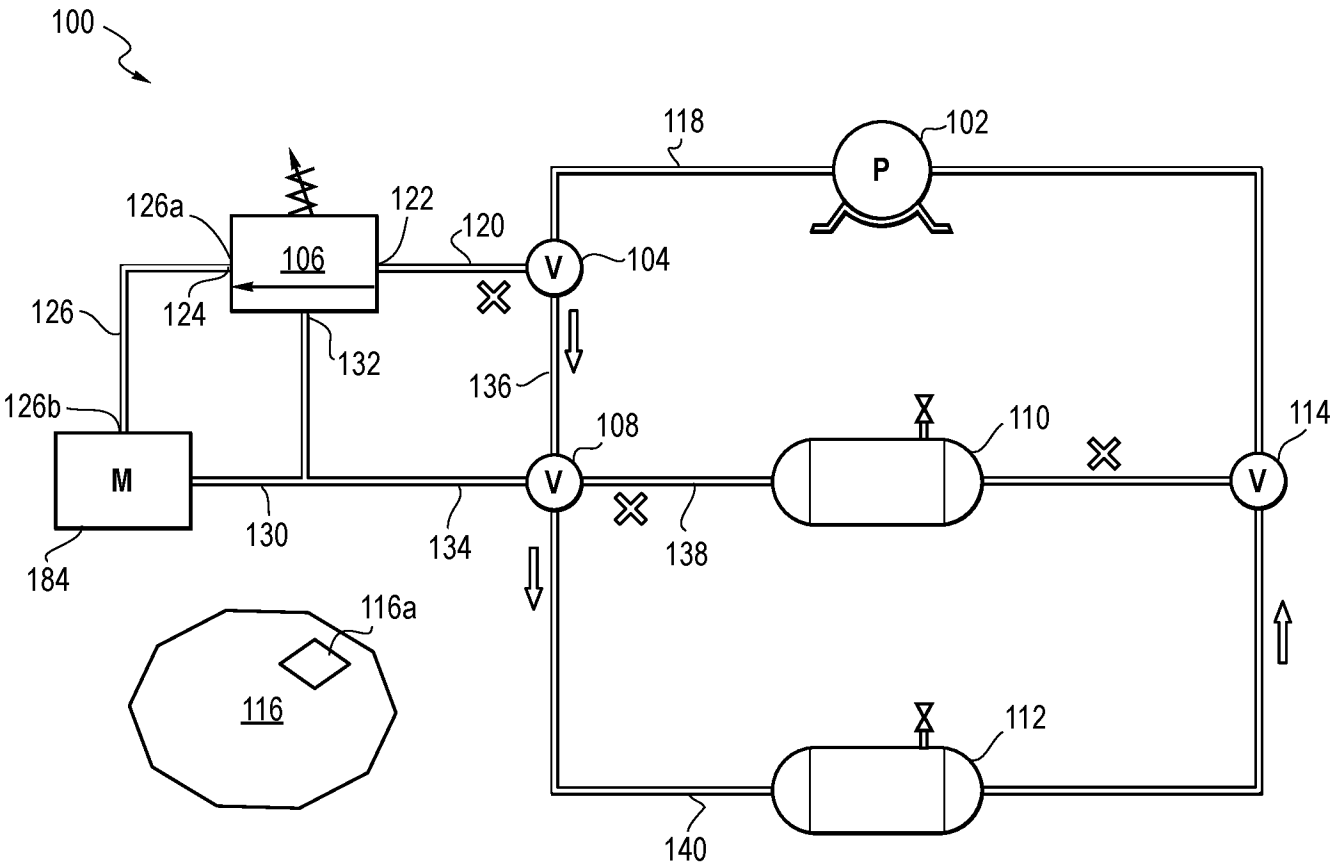
FIG. 7 shows a block diagram of an automated anti-freeze system for a sewer jetter system according to an embodiment of the invention at an antifreezed state according to a method of an embodiment of the invention.

In the third step, as shown in FIG. 6, the second valve 104 remains in its second position and the third valve 108 has shifted to its second position. Antifreeze liquid flowing through the first conduit 118 from the pump 102 is directed by the second valve 104 to the unloader 106, then ultimately to the third valve 108 via the working conduit 126 and the third conduit 134, and then is directed by the third valve 108 to the second tank 112 through the fifth conduit 140. When the system 100 operates in this configuration for a sufficient time for antifreeze liquid to circulate within the entire system, from the second tank 112, through the pump 102, the first, second, third, fifth, and seventh conduits 118, 120, 134, 140, and 130 (with the fourth and sixth conduits 136, 138 filled with non-circulating antifreeze liquid), the second and third valves 104, 108, the unloader 106, and the working conduit 126, and back to the second tank 112, the control system 116*a* concludes that the system has reached an antifreezed state. Then the pump 102 is automatically stopped based upon the instructions from the control system 116*a* while the power is still on. In such an antifreezed state, antifreeze liquid is kept in all parts of the system 100, which prevents liquid within the system from freezing in cold weather.

Before again using the jetter system for its intended purpose, the operator may recover the antifreeze liquid within the system for reuse. FIGS. 7-10 show a non-limiting example embodiment of a method for automatically recapturing antifreeze within a jetter system. In these figures, water in the system is shown with dashed lines, antifreeze liquid in the system is shown with solid lines, and the positions of the first and second auto valves are shown with arrows.

When the system 100 is in the antifreezed state, as shown in FIG. 7, the entire system 100 is filled with antifreeze liquid. To automatically recapture the antifreeze within the jetter system, the operator may rotate the rotary switch 142 on the control panel 116 to the auto recapture position 150 and pushes the ready button 1140, such that power is supplied to start the pump 102. Then the second valve 104 automatically sets to its first position, the third valve 108 automatically sets to its second position, and the first valve 114 automatically reconfigures to direct liquid from the first tank 110 to the pump 102, such that water is pushed to the pump 102 via the first valve 114.

Figure 8:
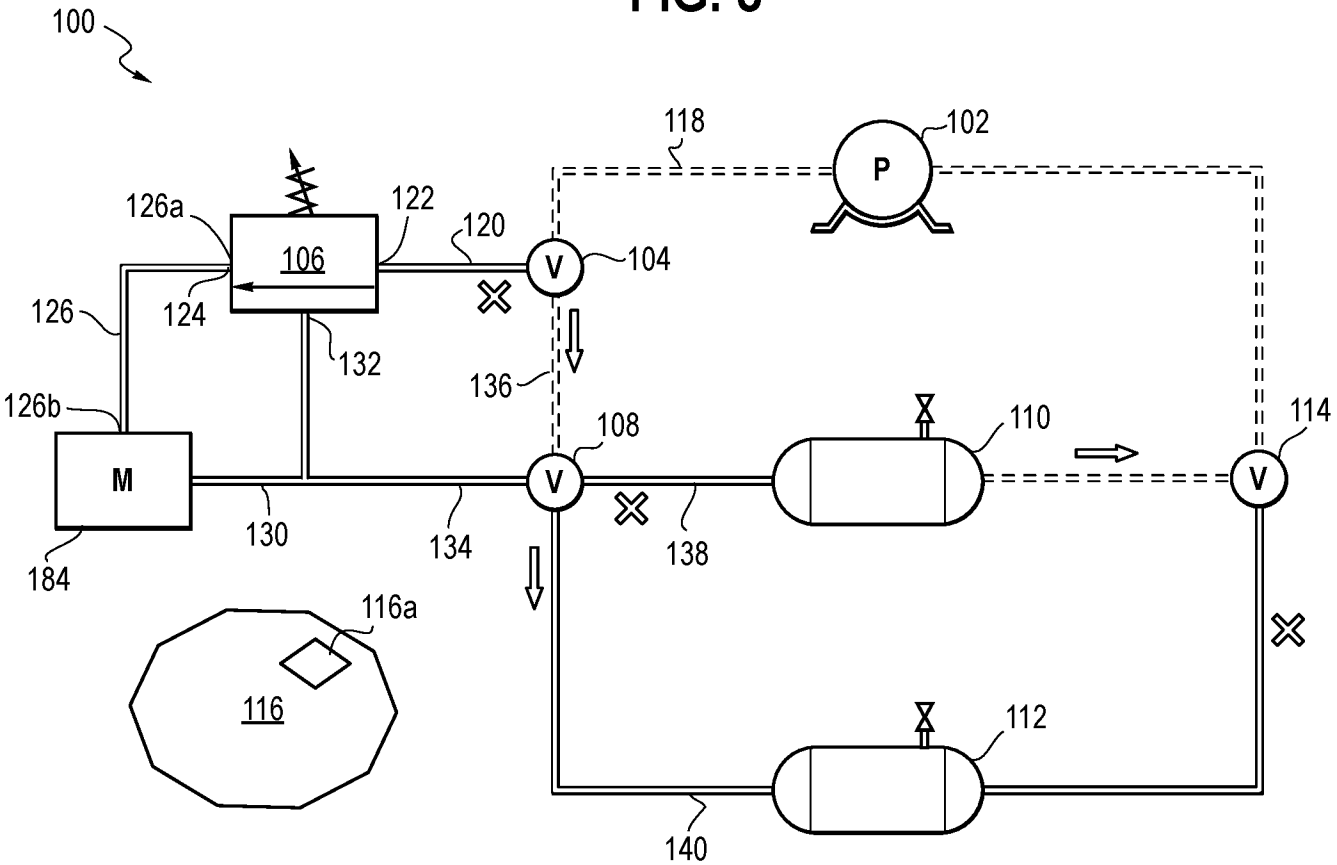
FIG. 8 shows a block diagram of an automated anti-freeze system for a sewer jetter system according to an embodiment of the invention at a first step of automatically recapturing antifreeze within a sewer jetter system according to a method of an embodiment of the invention.

In the first step, as shown in FIG. 8, water coming from the pump 102 to the second valve 104 is directed by the second valve 104 to the third valve 108 through the fourth conduit 136, such that water fills the first conduit 118 and the fourth conduit 136 and pushes antifreeze liquid out of these conduits into the second tank 112 through the fifth conduit 140 (with the third valve 108 ported to direct flow into the fifth conduit 140).

Once the water coming from the pump 102 reaches the third valve 108 and the control system 116*a* concludes that no antifreeze liquid remains within the first and fourth conduits 118, 136, as depicted in FIG. 8, the second valve 104 automatically shifts from its first position to its second position while the pump 102 is still on, such that liquid flowing through the pump 102 is directed by the second valve 104 through the second conduit 120 and into the unloader 106. In some embodiments, the control system 116*a* may be calibrated for how long to run the system in the orientation of each sub-routine in the method, i.e. how long to maintain the system as in the confirmation of FIGS. 7-10, as described above. The calibration may be related to predetermined parameters, such as a determined time needed to fill each portion of the system (i.e. the relevant conduits and valves, etc.) with water—when previously filled with antifreeze liquid—such that the system when each step is completed is expected to be fully of water (with the exception of the fifth conduit 140), while minimizing the time required to enter the auto recapture mode as well as the volume of water needed to fill the entire system (with the exception of the fifth conduit 140). In other embodiments, one or more of the respective conduits may include sensors that provide a signal to the control system 116*a* indicative of whether water or anti-freeze liquid is present at the sensor, and the control system 116*a* may operate the system between the various orientations discussed herein based completely or partially upon the sensed liquids.

Figure 9:
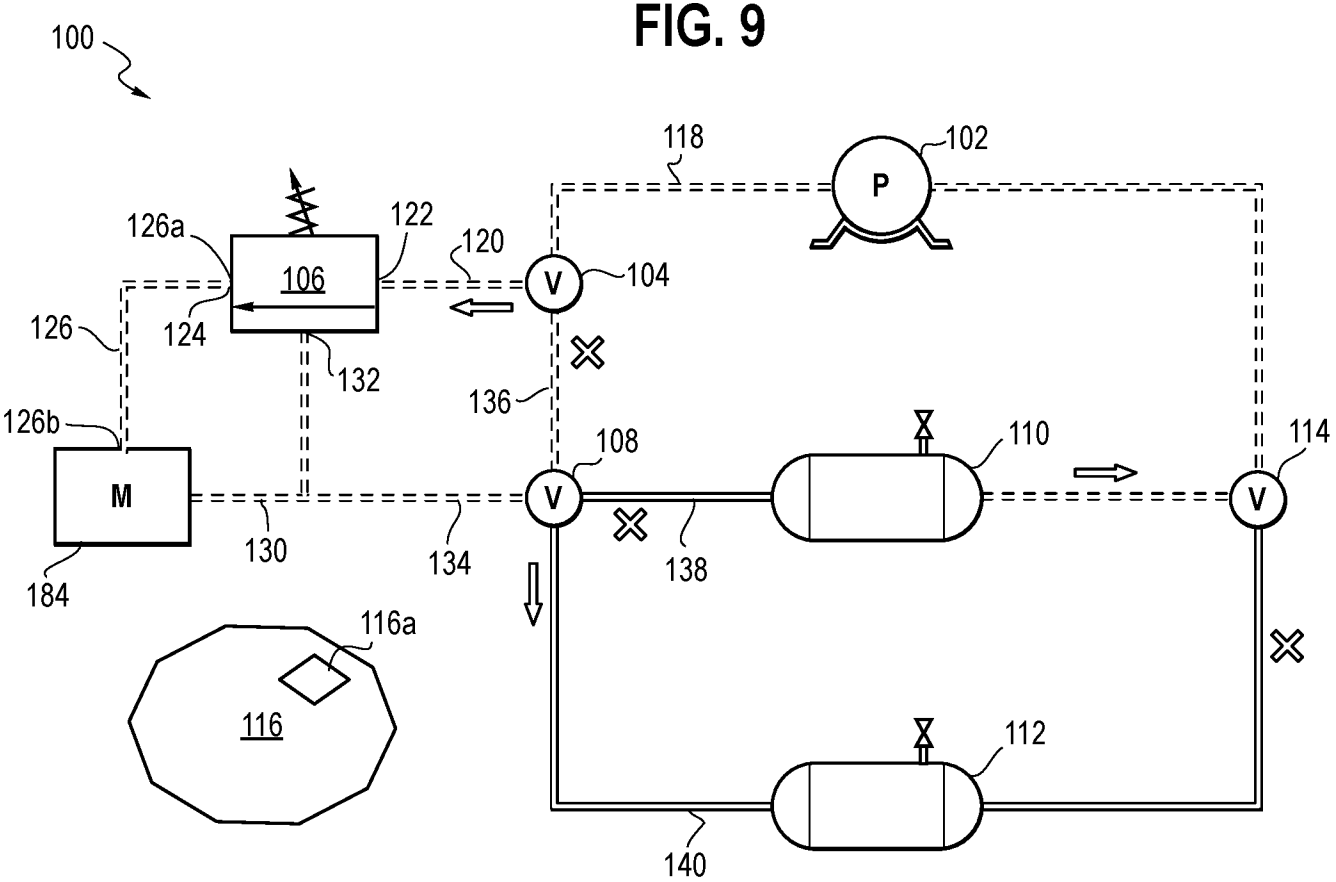
FIG. 9 shows a block diagram of an automated anti-freeze system for a sewer jetter system according to an embodiment of the invention at a second step of automatically recapturing antifreeze within a sewer jetter system according to a method of an embodiment of the invention.

In the second step, as shown in FIG. 9, the second valve 104 has shifted to its second position and the third valve 108 remains in its second position. Liquid flowing through the first conduit 118 from the pump 102 is directed by the second valve 104 to the unloader 106, and then ultimately to the third valve 108 via the working conduit 126, the seventh conduit 130 (when present a conduit between the manifold that receives the second end 126*b* of the working conduit 126 and the third conduit 134/unloader 106), and the third conduit 134, which is between the unloader 106 and the third valve 108. When the system operates in this configuration for a sufficient time for water to reach the third valve 108 (to ensure that the third conduit 134 is full of water), the control system 116*a* concludes that the antifreeze liquid within the second and third valves 104, 108, the unloader 106, the first, second, third, fourth, seventh, and the working conduits, 118, 120, 134, 136, 130, and 126 has been fully removed and replaced with water.

Once the control system 116*a* concludes that no antifreeze liquid remains within the second and third valves 104, 108, the unloader 106, the first, second, third, fourth, seventh, and the working conduits, 118, 120, 134, 136, 130, and 126, as depicted in FIG. 9, the second and third valves 104, 108 automatically shift from their second positions to their first positions while the pump 102 is still on, such that liquid flowing through the first conduit 118 from the pump 102 is directed by the second valve 104 through the fourth conduit and into the third valve 108, and then is directed by the third valve 108 through the sixth conduit and into the first tank 110.

Figure 10:
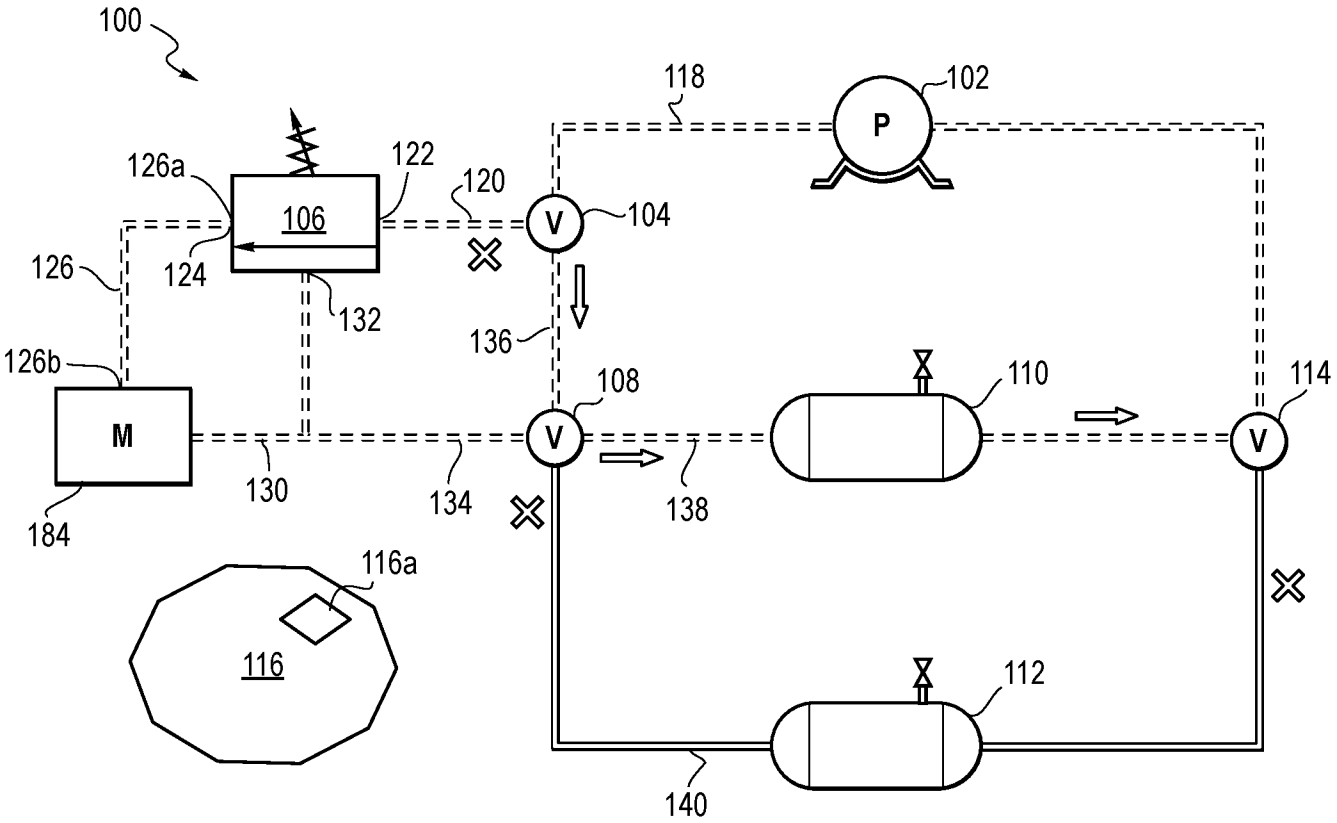
FIG. 10 shows a block diagram of an automated anti-freeze system for a sewer jetter system according to an embodiment of the invention at a third step of automatically recapturing antifreeze within a sewer jetter system according to a method of an embodiment of the invention.

In the third step, as shown in FIG. 10, the second and third valves 104, 108 have shifted their first positions. Water flowing through the first conduit 118 from the pump 102 is directed by the second valve 104 through the fourth conduit 136 and into the third valve 108, and then is directed by the third valve 108 through the sixth conduit 138 and into the first tank 110. When the system operates in this configuration for a sufficient time for water to reach the first tank 110 (to ensure that the sixth conduit 138 is full of water), the control system 116*a* concludes that the conduits of the system (with the exception of the fifth conduit 140) have been evacuated of all antifreeze liquid and replaced with water, including the first, second, third, fourth, sixth, and seventh conduits, 118, 120, 134, 136, 138, 130, the second and third valves 104, 108, the unloader 106, and the working conduit 126. Then the pump 102 is automatically stopped based upon the instructions from the control system 116*a* while the power is still on. In such a state, antifreeze liquid within the system has been recaptured into the fifth conduit 140 and the second tank 112, and the system is ready to perform its intended use (other than antifreeze liquid that was within the sixth conduit 138, which has been pushed into the first tank 110). FIG. 11 shows a flow chart of the process of automatically filling a jetter system with antifreeze liquid according to a method of an embodiment of the invention. The flow chart corresponds to the filling process explained hereinbefore with respect to FIGS. 3-6. At step 152, the operator may rotate the rotary switch 142 on the control panel 116 to the auto antifreeze position 146, turn on the power switch 144, and push the ready button 1140 such that pump 102 is started. At step 154, the second and third valves 104, 108 automatically set to their first positions, and the first valve 114 automatically reconfigures to direct liquid from the second tank 112 to the pump 102. At step 156, antifreeze liquid coming from the pump 102 is directed to the second valve 104 through the first conduit 118, and then to the third valve 108 through the fourth conduit 136. At step 158, the second valve 104 automatically shifts to its second position while the pump 102 is still on once the control system 116*a* concludes that no water remains within the first and fourth conduits 118, 136. At step 160, antifreeze liquid flowing from the pump 102 is directed to the second valve 104 through the first conduit 118, then to the unloader 106 through the second conduit 120, then ultimately to the third valve 108 through the working conduit 126, the seventh conduit 130, and the third conduit 134, and then to the first tank 110 through the sixth conduit 138. At step 162, the third valve 108 automatically shifts to its second position while the pump 102 is still on once the control system 116*a* concludes that the conduits of the system have been evacuated of all water and replaced with antifreeze, including the pump 102, the first, second, third, fourth, fifth, sixth, and seventh conduits 118, 120, 134, 136, 140, 138, and 130, the first and second valves 104, 108, the unloader 106 and the working conduit 126. At step 164, antifreeze liquid is directed to the second tank 112 through the fifth conduit 140. At step 166, the pump 102 is automatically stopped once the control system 116*a* concludes that the system has reached an antifreezed state.

FIG. 12 shows a flow chart of the process of automatically recapturing antifreeze liquid within a jetter system according to a method of an embodiment of the invention. The flow chart corresponds to the recapturing process explained hereinbefore with respect to FIGS. 7-10. At step 168, the operator may rotate the rotary switch 142 on the control panel 116 to the auto recapture position 150 and pushes the ready button 1140 such that the pump 102 is started. At step 170, the second valve 104 automatically sets to its first position, the third valve 108 automatically sets to its second position, and the first valve 114 automatically reconfigures to direct liquid from the first tank 110 to the pump 102. At step 172, water coming from the pump 102 is directed to the second valve 104 through the first conduit 118 and then to the third valve 108 through the fourth conduit 136. At step 174, the second valve 104 automatically shifts to its second position while the pump 102 is still on once the control system 116*a* concludes that no antifreeze liquid remains within the first and fourth conduits 118, 136. At step 176, water coming from the pump 102 is directed to the second valve 104 through the first conduit 118, then to the unloader 106 through the second conduit 120, and then ultimately to the third valve 108 through the working conduit 126, the seventh conduit 130 (when present, a conduit between the manifold that receives the second end 126*b* of the working conduit 126 and the third conduit 134/unloader 106), and the third conduit 134. At step 178, the second and third valves 104, 108 automatically shift to their first positions while the pump 102 is still on once the control system 116*a* concludes that the antifreeze liquid within the second and third valves 104, 108, the unloader 106, the first, second, third, fourth, seventh, and the working conduits, 118, 120, 134, 136, 130, and 126 has been fully removed and replaced with water. At step 180, water is directed to the first tank 110 through the sixth conduit 138. At step 182, the pump 102 is automatically stopped once the control system 116*a* concludes that the conduits of the system (with the exception of the fifth conduit) have been evacuated of all antifreeze liquid and replaced with water.

While the preferred embodiments of the present disclosure have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The invention claimed is:

1. An automated system for a remote sewer access system, comprising:

a control system configured to provide a normal operational mode, an auto antifreeze mode, and an auto recapture mode;

a pump;

a first tank selectively connectable with the pump through a first valve that is controllable by the control system, wherein the first valve is a three way valve which has a first position that directs liquid from the first tank to the pump, a second position that directs liquid from a second tank to the pump;

a second valve connected to the pump via a first conduit;

an unloader connected to the second valve with a second conduit;

a third valve connected to the unloader through a third conduit, wherein the second valve is connected to the third valve through a fourth conduit, and the third valve is connected to the second tank through a fifth conduit and is connected to the first tank through a sixth conduit; and a working conduit connected to the unloader at a first end of the working conduit, with an opposite second end of the working conduit connectable to the third valve via a seventh conduit;

wherein a position of the respective second and third valves are controlled by the control system, wherein the system is configured to allow transition from the normal operational mode to the auto antifreeze mode automatically based upon an instruction from an user of the system and when the second end of the working conduit is connected with the seventh conduit, wherein the transition from the normal operational mode to the auto antifreeze mode comprises the control system selectively operating the pump, and selectively operating each of the first, second, and third valves, to urge flow of antifreeze liquid from the second tank through each of the first, second, third, fourth, fifth, sixth, seventh conduits and the working conduit such that in the auto antifreeze mode, each of the first, second, third, fourth, fifth, sixth, and seventh conduits and the working conduit are filled with the antifreeze liquid from the second tank, and the system is configured to transition from the auto antifreeze mode to the auto recapture mode to urge the antifreeze liquid from the system to be removed from the first, second, third, fourth, sixth, seventh conduits and the working conduit and be replaced by liquid from the first tank, wherein the transition from the auto antifreeze mode to the auto recapture mode comprises the control system selectively operating the pump, and selectively operating each of the first, second, and third valves to urge flow of liquid from the first tank through each of the first, second, third, fourth, sixth, and seventh conduits and the working conduit such that in the auto recapture mode each of the first, second, third, fourth, sixth, and seventh conduits and the working conduit are filled with fluid from the first tank.

2. The automated system of claim 1, wherein the second and third valves are each configured to automatically shift positions based on predetermined parameters such that anti-freeze is directed to all parts of the automated anti-freeze system.

3. A method for automatically filling a sewer access system with antifreeze liquid, comprising:

setting the sewer access system to an auto antifreeze mode through a control system;

automatically positioning a first valve to direct an anti-freeze liquid from a second tank to a pump, the second tank provided to store antifreeze liquid, and setting a second valve and a third valve to their respective first positions;

pulling antifreeze liquid from the second tank to the pump via the first valve and then further to the second valve through a first conduit;

directing the antifreeze liquid flowing through the first conduit, via the second valve, through a fourth conduit and into the third valve;

automatically shifting the second valve to a second position;

directing the antifreeze liquid flowing through the first conduit from the pump, via the second valve, through a second conduit and into an unloader;

directing the antifreeze liquid from the unloader to the third valve through a working conduit and a third conduit;

directing the antifreeze liquid flowing through the third conduit, via the third valve, through a sixth conduit toward a first tank that is provided to store water for use in normal operations of the sewer access system;

automatically shifting the third valve to a second position;

directing the antifreeze liquid flowing through the third conduit, via the third valve, through the fifth conduit toward the second tank; and automatically stopping the pump once the control system concludes that first, second, third, fourth, fifth, and sixth conduits have received antifreeze therethrough.

4. The method for automatically filling a sewer access system with antifreeze liquid of claim 3, wherein when the second valve is in its first position, it is configured to direct liquid flowing through the first conduit from the pump to the third valve through the fourth conduit.

5. The method for automatically filling a sewer access system with antifreeze liquid of claim 3, wherein when the second valve is in its second position, it is configured to direct liquid flowing through the first conduit from the pump to the unloader through the second conduit.

6. The method for automatically filling a sewer access system with antifreeze liquid of claim 3, wherein when the third valve is in its first position, it is configured to direct liquid flowing through the third conduit and the fourth conduit to the first tank through the sixth conduit.

7. The method for automatically filling a sewer access system with antifreeze liquid of claim 3, wherein when the third valve is in its second position, it is configured to direct liquid flowing through the third conduit and the fourth conduit to the second tank through the fifth conduit.

8. The method for automatically filling a sewer access system with antifreeze liquid of claim 3, wherein the second and third valves automatically shift positions based on instructions from the control system.

9. The method for automatically filling a sewer access system with antifreeze liquid of claim 3, wherein the second and third valves automatically shift positions while the pump is on.

10. The method for automatically filling a sewer access system with antifreeze liquid of claim 3, further comprising automatically shifting the second valve to the second position once the control system concludes that the first and fourth conduits have received antifreeze therethrough.

11. The method for automatically filling a sewer access system with antifreeze liquid of claim 3, further comprising automatically shifting the third valve to the second position once the control system concludes that the conduits of the system have been evacuated of all water and replaced with antifreeze.

12. A method for automatically recapturing antifreeze liquid within a sewer access system, comprising:

setting the sewer access system to an auto recapture mode through a control system;

automatically reconfiguring a first valve to direct water from a first tank to a pump, wherein the first tank is configured to receive water for use by the sewer access system, setting a second valve to its first position, and setting a third valve to its second position;

directing water from the first tank to the pump and then to the second valve through a first conduit;

directing the water flowing through the first conduit, via the second valve, through a fourth conduit and into the third valve;

automatically shifting the second valve to its second position;

directing the water flowing through the first conduit, via the second valve, through the second conduit and into an unloader;

directing the water from the unloader to the third valve through a working conduit and a third conduit;

automatically shifting the second and third valves to their respective first positions;

directing the water flowing through the first conduit, via the second valve, to the third valve through the fourth conduit, and then via the third valve, to the first tank through the sixth conduit; and automatically stopping the pump.

13. The method for automatically recapturing antifreeze within a sewer access system of claim 12, wherein when the second valve is in its first position, it is configured to direct liquid flowing through the first conduit from the pump to the third valve through the fourth conduit.

14. The method for automatically recapturing antifreeze within a sewer access system of claim 12, wherein when the second valve is in its second position, it is configured to direct liquid flowing through the first conduit from the pump to the unloader through the second conduit.

15. The method for automatically recapturing antifreeze within a sewer access system of claim 12, wherein when the third valve is in its first position, it is configured to direct liquid flowing through the third and fourth conduits to the first tank through the sixth conduit.

16. The method for automatically recapturing antifreeze within a sewer access system of claim 12, wherein when the third valve is in its second position, it is configured to direct liquid flowing through the third and fourth conduits to the second tank through the fifth conduit.

17. The method for automatically recapturing antifreeze within a sewer access system of claim 12, wherein the second and third valves automatically shift positions based on instructions from the control system.

18. The method for automatically recapturing antifreeze within a sewer access system of claim 12, wherein the second and third valves automatically shift positions while the pump is on.

19. The method for automatically recapturing antifreeze within a sewer access system of claim 12, further comprising automatically shifting the second valve to its second position once the control system concludes that no antifreeze liquid remains within the first and fourth conduits.

20. The method for automatically recapturing antifreeze within a sewer access system of claim 12, further comprising automatically shifting the second and third valves to their respective first positions once the control system concludes that the antifreeze liquid within the second and third valves, the unloader, the first, second, third, fourth, seventh, and the working conduits has been fully removed and replaced with water.

* * * * *